United States Patent [19]

Anderson, II

[11] 4,340,100

[45] Jul. 20, 1982

[54] RAFTER SUPPORT JIG

[76] Inventor: George D. Anderson, II, 1004 Oregon Ave., Erie, Pa. 16505

[21] Appl. No.: 195,882

[22] Filed: Oct. 10, 1980

[51] Int. Cl.[3] ..... B27M 3/02

[52] U.S. Cl. ..... 145/1 R; 33/180 R; 33/DIG. 16; 145/1 B; 145/129; 52/127; 269/41; 269/315; 403/232.1

[58] Field of Search ..... 145/1 B, 1 R, 129; 269/41, 315; 33/180, DIG. 16; 52/127, 702; 403/232.1; 248/291, 286

[56] References Cited

U.S. PATENT DOCUMENTS

| | | | |
|---|---|---|---|
| 537,504 | 4/1895 | Van Dorn | 403/232.1 X |
| 1,720,104 | 7/1929 | Taylor et al. | 403/232.1 |
| 2,911,690 | 11/1959 | Sanford | 403/232.1 |
| 3,357,464 | 12/1967 | Vroman | 145/1 R |
| 3,456,702 | 7/1969 | Johnson | 33/180 R X |
| 3,596,941 | 8/1971 | Tracy | 403/232.1 X |
| 4,261,155 | 4/1981 | Gilb | 403/232.1 X |

*Primary Examiner*—Donald R. Schran
*Attorney, Agent, or Firm*—Charles L. Lovercheck; Wayne L. Lovercheck; Dale R. Lovercheck

[57] ABSTRACT

A rafter jig made up of an angular rafter bracket and a rafter support swingably connected to the rafter bracket and apparatus to adjust and lock the rafter support in angular position relative to the ridge pole bracket.

7 Claims, 4 Drawing Figures

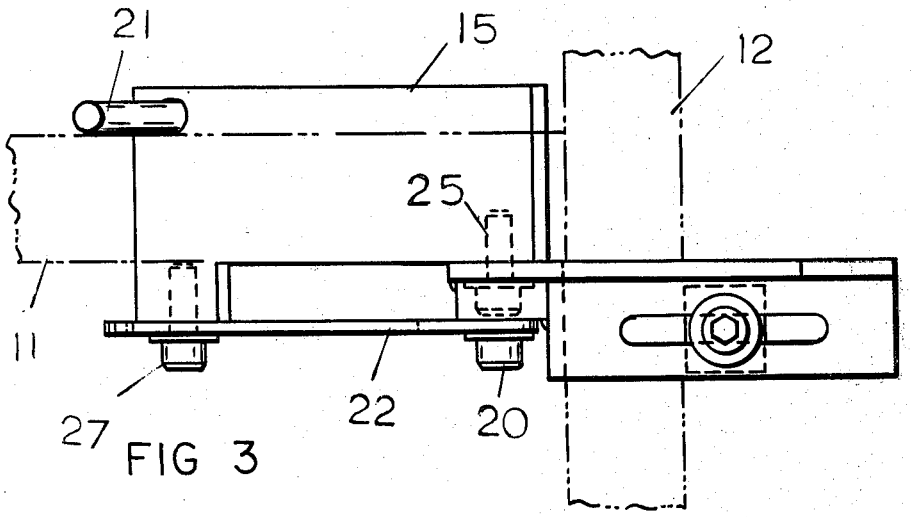
FIG 3
FIG 4
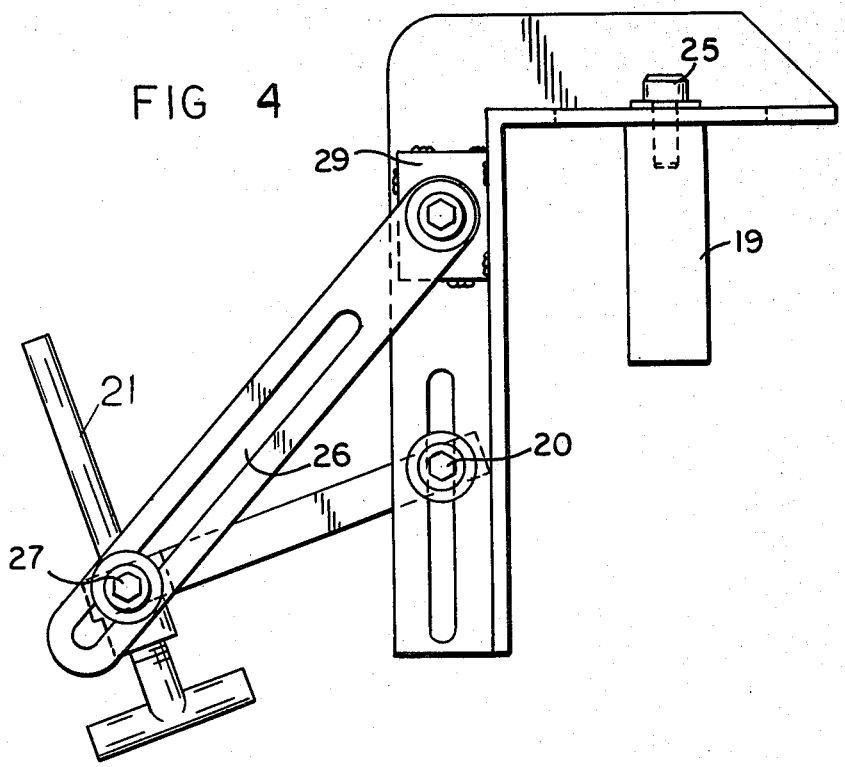

RAFTER SUPPORT JIG

GENERAL DESCRIPTION OF THE INVENTION

This invention relates to a rafter jig for holding rafters in rigid position relative to a ridge pole during the nailing process to provide for extreme accuracy, convenience and reduction in labor. The rafter jig is made up of a ridge pole bracket that holds the ridge pole rigidly in position and a rafter support plate swingably supported on the ridge pole bracket and an adjustable arm swingably supporting the distal end of the rafter support to the ridge pole bracket. The rafter support can be adjusted up and down for different size rafters and can be adjusted to different angles for different pitch roofs.

REFERENCE TO PRIOR ART

The following patents are from the same field as applicant's invention, however, none of them anticipate applicant's invention.

U.S. Pat. Nos. 725,756, 3,249,135, 2,718,247, 3,357,464, 2,911,022, 3,456,702.

OBJECTS OF THE INVENTION

It is an object of the invention to provide an improved rafter support jig.

Another object of the invention is to provide a rafter support jig that is simple in construction, economical to manufacture and simple and efficient to use.

Another object of the invention is to provide a rafter support jig that can be quickly adjusted to hold any size rafter and any pitch groove.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 3 is a top view of the rafter support jig shown in FIGS. 1 and 2.

FIG. 4 is a view of the rafter support jig taken from the side opposite FIG. 2.

DETAILED DESCRIPTION OF THE DRAWINGS

Figure 1:
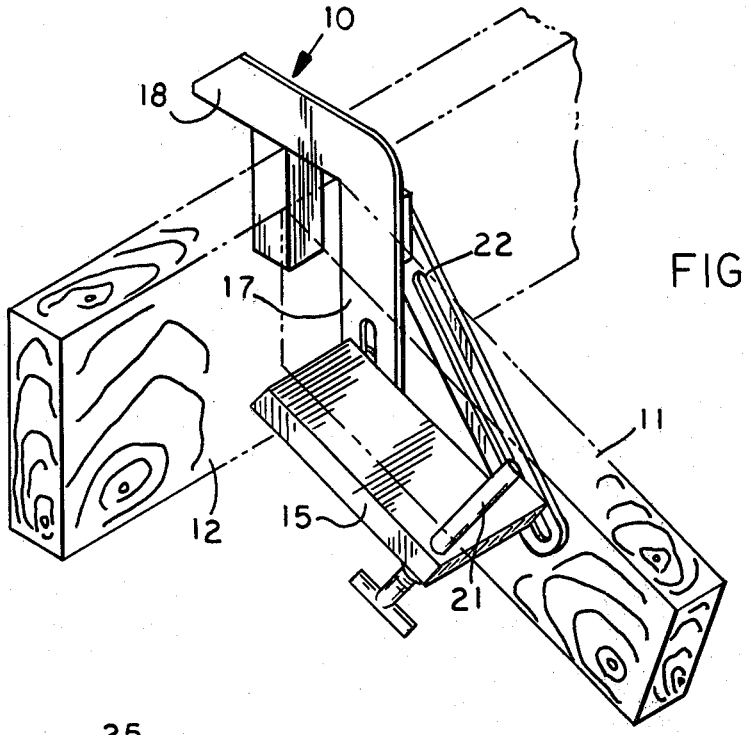
FIG. 1 is an isometric view of the rafter support jig according to the invention.
Figure 2:
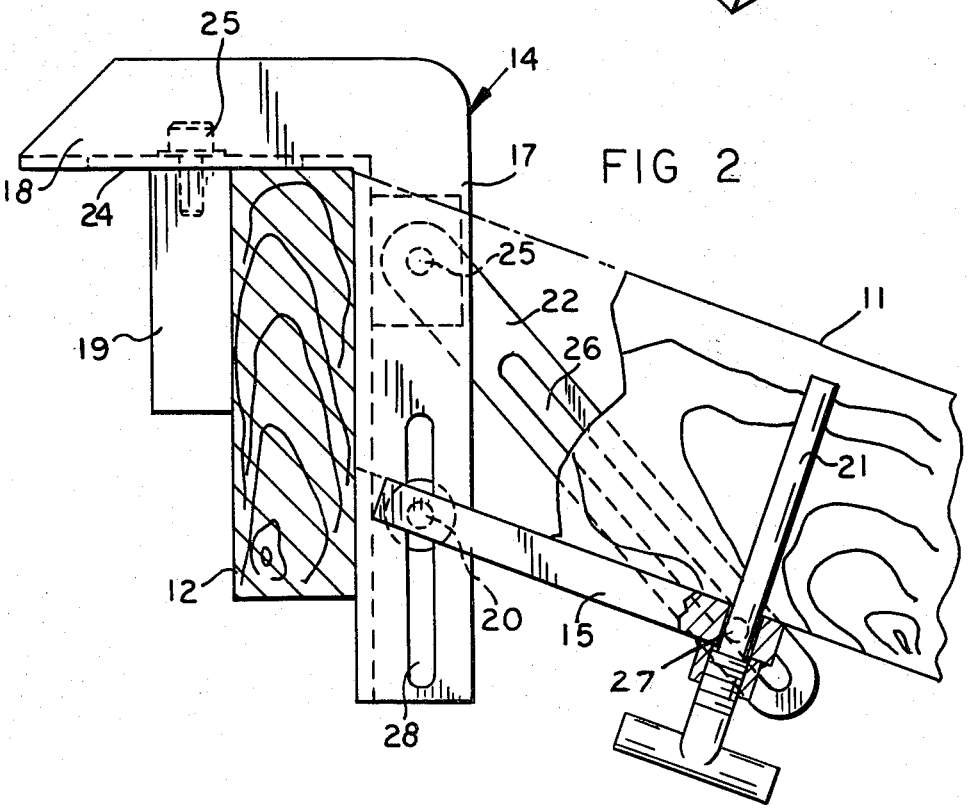
FIG. 2 is a side view of the rafter support jig shown in FIG. 1.

Now, with more particular reference to the drawings, the jig 10 is intended to support rafters 11 in place against a ridge pole 12 during the assembly process. The jig has a ridge pole bracket 14, a rafter support 15 and a brace 16. The ridge pole bracket is made of angular material and supported at right angles to each other, they may be welded together. The first part 17 and the second part 18 are rigidly fixed together by welding or the like and generally at right angles to each other. The first part is adapted to rest on one side of the ridge pole 12 and a second part 18 is adapted to rest on top of the ridge pole 12. A third part 19 of the ridge pole bracket is fixed to the second part 18 and extends downward therefrom. The third part may be fixed to the second part by means of a bolt 25 which is received in bolt 25 and held in position by the stud 25, thus, the third part 19 may be adjusted away from the first part 17 to accommodate different thicknesses of ridge poles 12.

The first part 17, and the second part 18 of the ridge pole bracket are fixed together and the first part 17 is spaced from the third part 19 and extends downwardly generally parallel to the third part 19. The first part 17 and second part 18 receives a ridge pole between them. The pivot means 20 swingably supports the rafter support 15 and the pin means 21 extends upwardly through the threaded hole in the rafter support. The pin 21 provides a convenient means for laterally supporting one side of the rafter on the rafter support 15. Brace 22 is swingably connected to the rafter support bracket by a pin pivot 25 and the bracket 22 has a slot 26 which receives the stud 27, which may be slidably locked in the slot 26. The leg 17 has a slot 28 which slidably receives the pivot means 20 which is a threaded stud which may be locked in position.

The leg 17 has a pad 29 welded to it into which the pivot 25 is threadably received.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A jig (10) for holding a rafter (11) in place on a ridge pole (12) comprising a ridge pole bracket (14), a rafter support (15), and a brace (16), said ridge pole bracket having a first part (17) and a second part (18), said first part (17) and said second part (18) being rigidly fixed together and disposed generally at right angles to each other, said first part extending downwardly and being adapted to rest on one side of said ridge pole (12), said second part (18) being adapted to rest on top of said ridge pole, a third part (19) of said ridge pole bracket fixed to said second part and spaced from said first part (17) and extending downward generally parallel thereto, said first part (17) and said third part (18) receiving said ridge pole therebetween, pivot means (20) swingably connecting said rafter support to said first part of said ridge pole bracket and a pin means (21) extending upwardly from said rafter support and adapted to engage one side of said rafter, and said brace (22) swingably connected to said first part of said ridge pole bracket and to said rafter support (15) for holding said ridge pole in predetermined position to said rafter bracket.

2. The jig recited in claim 1 wherein said first part (17) of said ridge pole bracket (14) has a slot thereon and said pivot means (20) is slidably supported in said slot.

3. The jig recited in claim 2 wherein said pivot means (20) comprises a threaded member fixed to said rafter support (15) and having a nut means on the distal end thereof.

4. The jig recited in claim 2 or 3 wherein said rafter support has threaded means thereon and said pin has a threaded part received in said threaded means.

5. The jig recited in claim 3 wherein said brace (22) has a slot, said slot receiving said pivot means attached to said brace.

6. The jig recited in claim 1 wherein said first part and said second part of said ridge pole bracket are in the form of angle irons each having a flange lying in a plane parallel to one surface of the rafter.

7. The jig recited in claim 1 wherein said rafter support is in the form of a plate having said pivot means (20) attached to the edge of said plate.

* * * * *